United States Patent [19]

DeVore

[11] Patent Number: 4,882,577

[45] Date of Patent: Nov. 21, 1989

[54] CALLIGRAPHIC CONTROL FOR IMAGE SUPERIMPOSITION

[75] Inventor: Douglas M. DeVore, Torrance, Calif.

[73] Assignee: Hughes Aircraft Company, Los Angeles, Calif.

[21] Appl. No.: 277,425

[22] Filed: Nov. 25, 1988

Related U.S. Application Data

[63] Continuation of Ser. No. 745,031, Jun. 7, 1985, abandoned.

[51] Int. Cl.[4] ..... G09G 1/10

[52] U.S. Cl. ..... 340/739; 340/732; 340/736; 340/751

[58] Field of Search ..... 340/720, 721, 725, 726, 340/732, 734, 736, 739, 743, 745, 747, 751; 358/183

[56] References Cited

U.S. PATENT DOCUMENTS

| | | | |
|---|---|---|---|
| Re. 31,200 | 4/1983 | Sukonick et al. | 340/725 |
| 3,665,450 | 5/1972 | Leban | 340/751 |
| 3,848,246 | 11/1974 | Kendall | 340/743 |
| 3,891,792 | 6/1975 | Kimura | 340/726 |
| 4,209,832 | 6/1980 | Gilham et al. | 340/734 |
| 4,408,197 | 10/1983 | Komatsu et al. | 340/720 |
| 4,495,642 | 1/1985 | Zellmer | 340/720 |
| 4,555,700 | 11/1985 | Convis | 340/721 |
| 4,623,915 | 11/1986 | Bolger | 358/183 |

*Primary Examiner*—David K. Moore
*Assistant Examiner*—Jeffery A. Brier
*Attorney, Agent, or Firm*—Leonard A. Alkov; Wanda Denson-Low

[57] ABSTRACT

A system is disclosed which allows two image signal sources with different update rates to timeshare a single calligraphic display monitor, such that the resulting image is a combination of the image data from both sources. The image signals from one source are monitored and analyzed by the system controller, which is adapted to locate temporal locations of the correct duration and frequency in the update cycle when the first source is not writing to the monitor. The controller controls the triggering of write signals by the second source to occur in the located temporal location in the write cycle of the first source. The controller also controls an analog switch for switching the image signals to the monitor during the times when the second image source is writing to the monitor. By controlling the timing of write signals from the second source, the two sources are maintained in the correct phase relationship with no overlap of write signals.

5 Claims, 5 Drawing Sheets

CALLIGRAPHIC CONTROL FOR IMAGE SUPERIMPOSITION

This application is a continuation of application Ser. No. 745,031, filed June 7, 1985, now abandoned.

BACKGROUND OF THE INVENTION

This invention relates to calligraphic (or stroke) cathode ray tube (CRT) display systems, and more particularly to an improved system for superimposing image data received from two sources on one CRT display.

Calligraphic CRT displays (also known as stroke or vector displays) are often used in applications requiring high resolution or special purpose graphic display capabilities. The usual application employs one CRT monitor for each source of display data. There are applications in which it would be useful to mix signals from two separate sources to drive one CRT display and present superimposed images. Thus, for example, a primary equipment may produce a stroke signal for display on the CRT monitor to which additional data is to be added or superimposed from another source. If the two sources operate at different refresh rates, mixing the two sources to obtain an acceptable image quality is a problem not suitably addressed by the prior art.

A known way to mix two stroke signals into one monitor is scan conversion. With this method, each signal is displayed on a separate monitor. Each monitor display is recorded by separate raster television cameras, and the two raster outputs are mixed and displayed on a raster monitor. This method is hard to calibrate, takes up a significant amount of physical space, requires use of a raster monitor with some resulting loss of image fidelity, and is relatively expensive.

Another method to mix two stroke signals with different refresh rates is to chop back and forth between the two signals, similar to the manner in which dual traces are displayed on dual trace oscilloscopes. When the two signals have different refresh rates, this technique produces many problems, such as loss of data, flickering, visibility of retrace vectors, and the like.

It would therefore be an advance in the art to provide a technique for mixing together stroke signals from sources having different refresh rate which minimizes the loss of displayed data, flicker, and image degradation.

SUMMARY OF THE INVENTION

A system is disclosed for superimposing on a calligraphic display monitor two images from image sources, thereby timesharing one monitor between two sources. The set of write signals from one source is monitored and analyzed to provide a trigger signal for controlling the writing of the second source. The respective sets of image signals from the two sources are coupled to an analog switch which is adapted to select the set of signals from the controlled source or the set of signals from the monitored source, and couple the selected set through a video driver to the deflection circuits and the beam intensity control circuit of the calligraphic display monitor.

The system includes a controller which monitors and analyzes the cycle of the set of image signals from the monitored source to determine temporal locations during which the first image source is not writing to the monitor, and which are of appropriate duration and frequency to accommodate the write cycle of the second image source. The controller controls the clocking of write data from the controlled image source to occur during the appropriate temporal locations in the write cycle of the controlled image source. The controller provides switch signals to the analog switch, ensuring that the image signals from the monitored source are coupled to the monitor when the monitored source is writing to the display, and that image signals from the controlled source are coupled to the monitor when the controlled source is writing to the monitor.

BRIEF DESCRIPTION OF THE DRAWINGS

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
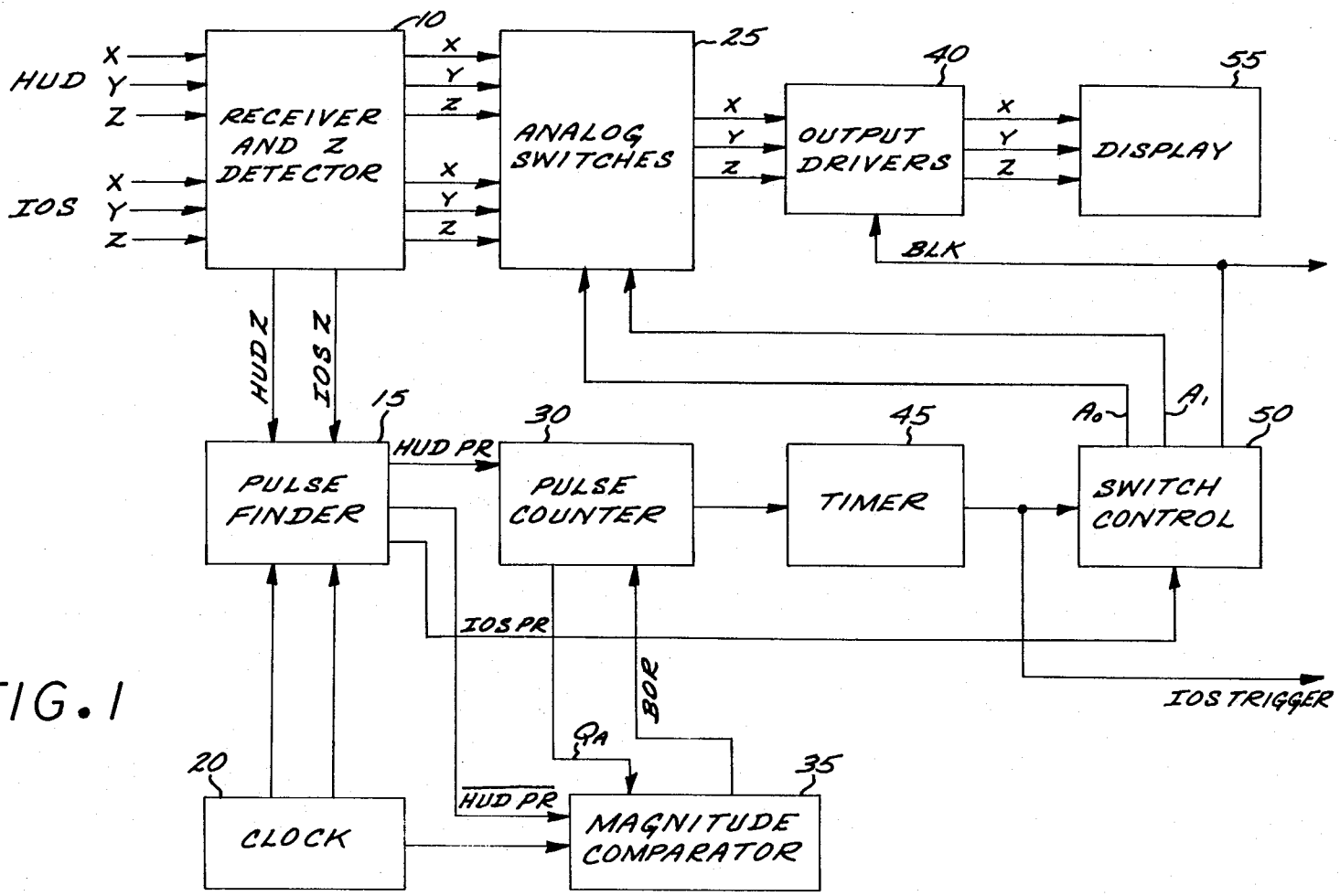
FIG. 1 is a simplified block diagram of an image superposition control system employing the invention.

The present invention comprises a novel control system for calligraphic image superposition. The following description is presented to enable any person skilled in the art to make and use the invention, and is provided in the context of a particular application and its requirements. Various modifications to the preferred embodiment will be readily apparent to those skilled in the art, and the generic principles defined herein may be applied to other embodiments and applications. Thus, the present invention is not intended to be limited to the embodiment shown, but is to be accorded the widest scope consistent with the principles and novel features disclosed herein.

The invention allows two image signal sources with the same or different update or refresh rates to be "mixed" and displayed on one calligraphic stroke monitor. One source is monitored and the other source is controlled by the control circuit. Thus, one source may be from equipment to which access to timing is either not available or is undesirable, and the basic update rate can be different from the update rate of the controlled signal. The control circuit employs timers and pulse finder circuits to analyze the monitored signal and derive a trigger signal. This signal controls the second source to provide write information in time gaps in which the monitored signal is inactive, i.e., in the non-writing state, such that the two signals are in the correct phase relationship with no overlap of signals. Thus, the two signals can be mixed, regardless of their respective refresh rates, so long as one signal is from a controllable source, and the monitored signal has a waveform with inactive regions or gaps.

The particular application in which the disclosed embodiment of the invention is employed is an aircraft simulator, and the two signals which are mixed are the "head up" display ("HUD") signal from an aircraft and a graphics computer signal (the "IOS" signal). The HUD clock signal is not controllable by external sources, and therefore it is the signal that is monitored by the control circuit. The graphic computer may comprise, for example, the "Graphic 7" computer marketed by the Sanders Information Products Division, Nashua, NH. This graphic computer has the capability to be clocked by an external, real time trigger signal. Thus, application of the trigger signal causes the computer to generate a cycle of image write data.

The CRT beam intensity (or "Z" ) signal from the HUD is detected, and a signal is provided that is high whenever the HUD is writing to the CRT calligraphic display. This "envelope" signal is used by the controller to determine when the HUD is providing write data to the monitor, and also to predict when the HUD will not be providing write data, i.e., when there will be a time or temporal gap in the writing to the display by the HUD.

The basic write rate for the HUD set of signals is 60 Hz and the write rate for the IOS set of signals from the graphics computer is 40 Hz. To accommodate the IOS signal, gaps occurring at a 40 Hz rate are detected in the HUD envelope write signal by the controller. The controller uses some gaps in the HUD write signal as they occur to switch the display to the IOS draw signals, and predicts when other gaps will occur. The controller ensures that the graphics computer receives regular write commands at a 40 Hz rate which are synchronized with the HUD write signal, so that the two signals never overlap and interfere with each other. As a result, the calligraphic monitor superimposes the graphics computer-generated information with the HUD-generated information.

Figure 5:
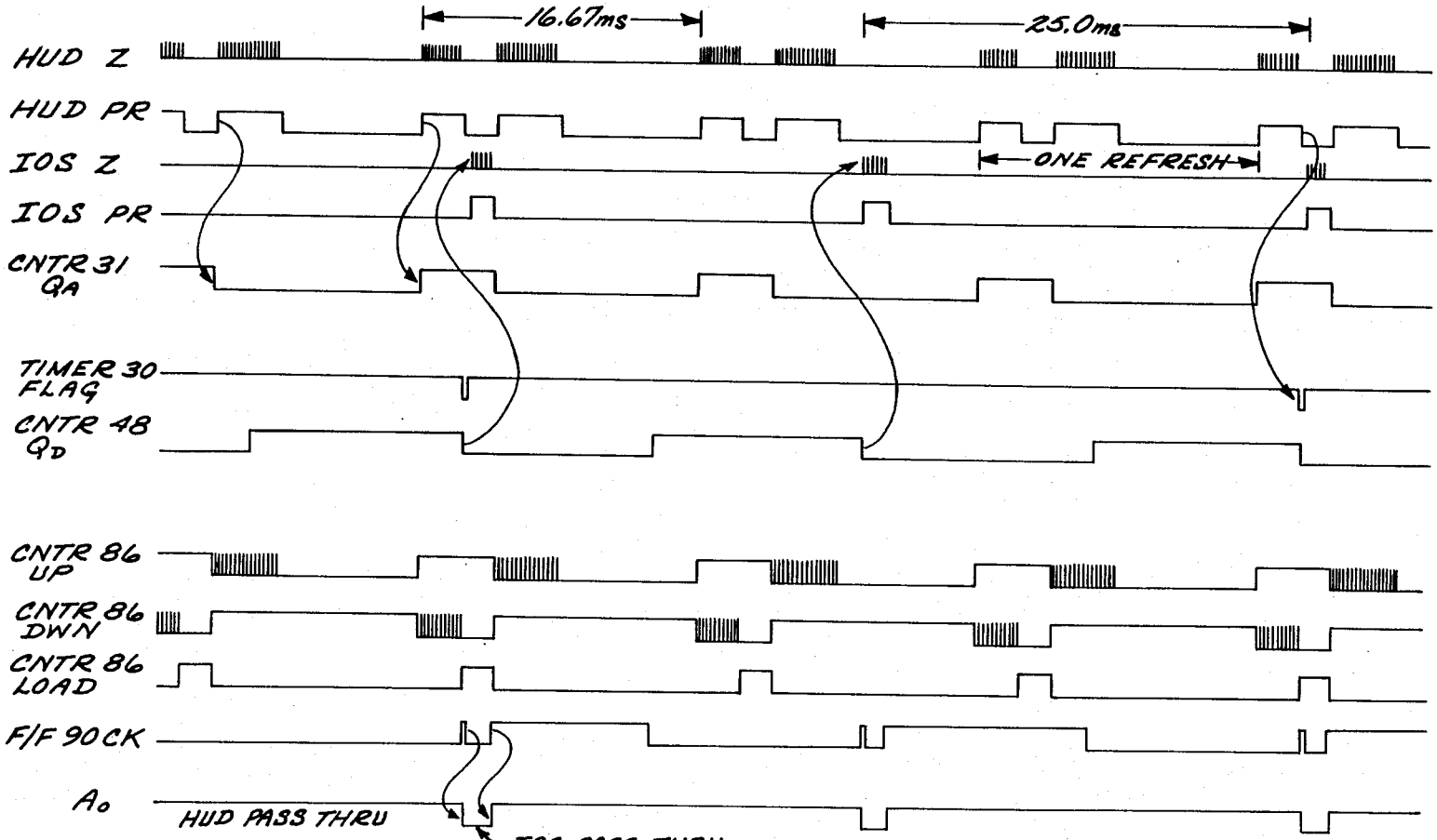
FIG. 5 is a signal waveform graph, illustrating pertinent signal waveforms of the system illustrated in FIGS. 1–4.

As seen in the timing diagram of FIG. 5, the "HUD Z" signal, i.e., the beam intensity signal which modulates the monitor beam intensity circuit, is not a set of continuous signals which extend for a time interval in the refresh cycle, but instead a relatively small gap or inactive section occurs in every draw cycle between two series of write signals. The amplitude of the "HUD Z" signal is effectively null or zero in the inactive sections. This gap occurs when the HUD stops writing characters and begins to draw lines and circles. Following the second series of draw signals in each cycle is a relatively long time gap during which the HUD signal is inactive. The cycle repeats at the end of the long gap.

Every third small gap in the HUD signal waveform is 50 milliseconds (msec) apart, i.e., twice the period of the IOS cycle. Moreover, the interval commencing 25 msec after every small gap falls into the large gap in which the HUD write signal is inactive in the next HUD cycle. Taking advantage of this periodicity of the HUD write signal allows the IOS image source to be clocked at a 40 Hz rate derived from the HUD signal itself, and readily permits control of the display system so that both the HUD and IOS timeshare the calligraphic display device.

FIG. 1 is a block diagram of a calligraphic control system employing the invention. Both the HUD and IOS sources provide X,Y and Z signals, the X and Y signals for controlling the X and Y beam deflection circuitry of the calligraphic display 55, and the Z signal controlling the intensity of the beam. The X, Y and Z signals from both sources are provided to the receiver and Z detector circuit 10, and after amplification by circuit 10, are coupled to the analog switch circuit 25.

The analog switch circuit is controlled by the switch signals $A_0$, $A_1$, which determine whether the HUD signals, the IOS write signals or the controller test signals are provided to the display 55 through output driver 40.

The circuit 10 also provides HUD Z and IOS Z signals, which are coupled from the Z detector circuit 10 to a pulse finder circuit 15. This circuit determines when the HUD is writing, and provides a continuous high logic pulse "HUD PR" during the HUD draw. The circuit also determines when the IOS source is writing and provides a continuous high logic pulse "IOS PR" during the IOS draw.

The circuit 15 comprises two retriggerable digital one-shot timers to provide the HUD PR and IOS PR signals. The Z signals for each source switch on and off quite rapidly, and the HUD PR and IOS PR output signals from the pulse finder circuit stay "high" for a predetermined time interval after the signal is off. If the respective Z signal is turned on again while the respective output signal is still high, the timer is retriggered. The pulse width is adjustable, in dependence on the characteristics of each respective Z signal.

A crystal clock generator circuit 20 generates respective 100 Khz and 1 Mhz clock signals to clock the respective HUD timer and IOS timers comprising the pulse finder circuit 15. The clock generator circuit 20 also generates a 10 Khz clock signal to clock the magnitude comparator circuit 35.

The HUD PR signal from pulse finder circuit 15 is coupled to the pulse counter circuit 30, which is adapted to find every third refresh of the HUD draw, or every sixth pulse of the HUD PR signal since there are two draw sequences during each HUD refresh cycle. Thus, the pulse counter circuit 30 performs a "divide by six" function on the HUD PR signal, to provide a flag signal that commences at the onset of every third small gap in the HUD Z signal write waveform.

The flag signal from the pulse counter circuit 30 is coupled to the timer circuit 45. The flag signal triggers a timer, generating an immediate timer pulse and a second timer pulse after a 25 msec time delay. The first and second timer pulses are buffered to provide an IOS trigger signal pulse occurring every 25 msec, i.e., at a 40 Hz rate. The beginning of each trigger pulse will occur during a gap in the draw sequence of the HUD, and therefore the IOS is triggered to draw in the gap.

The control system further comprises a magnitude comparator circuit 35. The function of this circuit is to ensure that the reset flag signal occurs during the short gap in the HUD refresh cycle, and not during the longer gap.

The timer 45 output signal is provided to the switch control circuit 50 for controlling the analog switches 25. The switch control circuit 50 generates the switch control signals $A_0$, $A_1$ which control the particular set of draw signals which are applied to the display 55.

Figure 2:
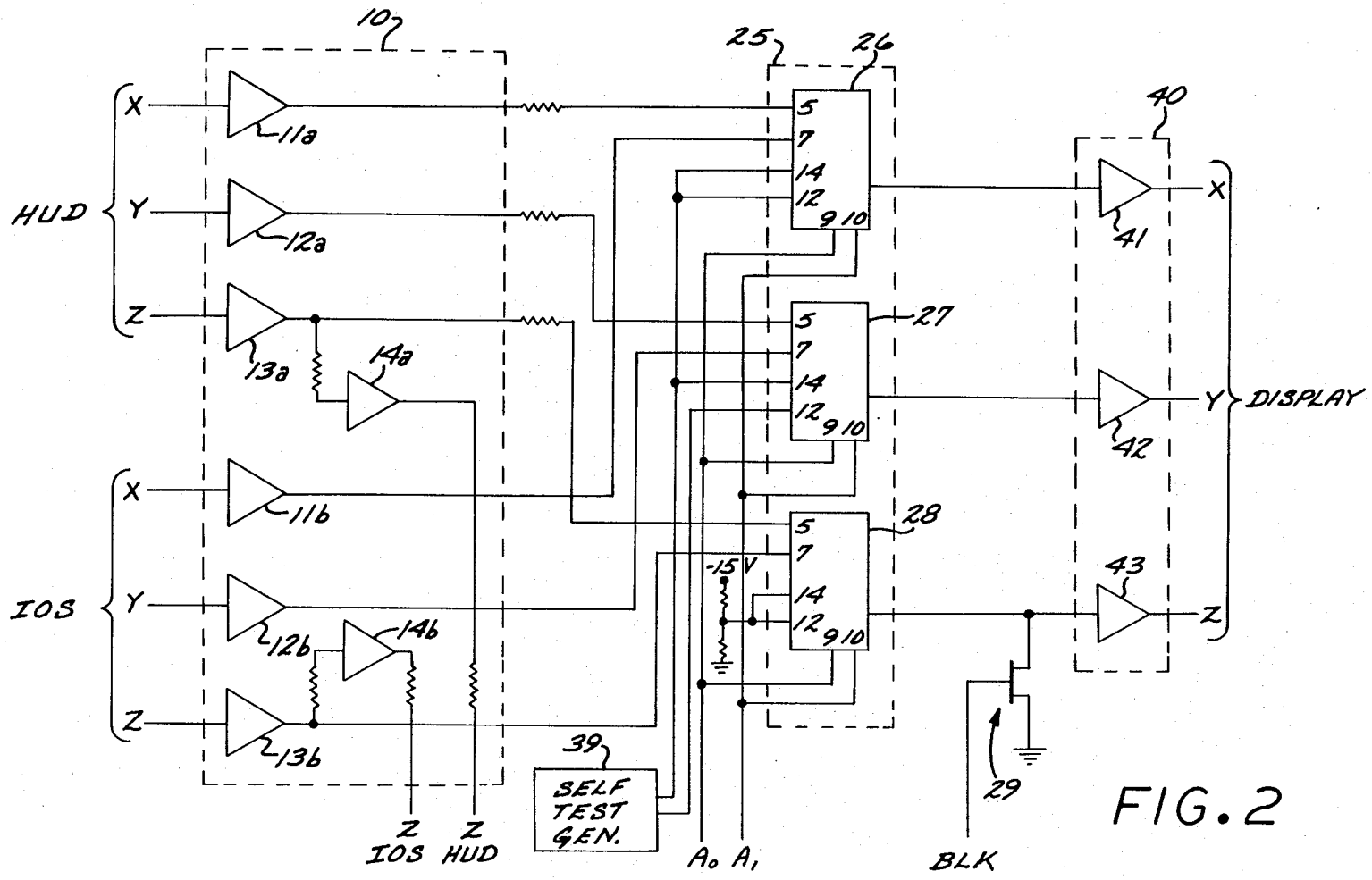
FIGS. 2, 3 and 4 are simplified schematic drawings of the image superposition control system illustrated in the block diagram of FIG. 1.

The simplified schematic diagram of FIG. 2 is illustrative of the analog section of the system generally depicted in FIG. 1. The receiver and Z detector circuit 10 comprises operational amplifiers 11*a*, 12*a* and 13*a* coupled respectively to the set of X, Y, Z signals from the HUD, and operational amplifiers 11*b*, 12*b*, 13*b* coupled respectively to the set of X, Y, Z signals from the IOS graphics computer. In the disclosed embodiment, these operational amplifiers comprise sections of a Harris HA1-5190 amplifier circuit. The biasing circuitry for the operational amplifiers is omitted for clarity.

The analog switch section 25 comprises one-of-four decoder devices 26, 27, 28. In the disclosed embodiment, Harris HA1-5248 decoder devices are employed as the decoder devices.

The respective outputs from amplifiers 11a, 11b are coupled as inputs to the decoder 26. Thus, the decoder is adapted to select one of the amplified signals from the HUD, the IOS or the test signal source 39. The output of the decoder 26 is provided to the X driver 41, and the output of driver 41 is coupled to the X deflection circuitry of the display. The amplifiers 41, 42, 43 comprising driver section 40 are also Harris HA1-5190 operational amplifiers.

In a similar fashion, decoder 27 selects one of the amplified signals from the HUD, the IOS or the test signal source 39, and couples the selected signal to the driver amplifier 42, whose output is coupled to the Y deflection circuitry of the display.

The amplified signals from the HUD, the IOS source or the test signal source 39 are coupled as inputs to decoder 28, which couples the selected signal to the driver amplifier 43, whose output is in turn coupled to the beam intensity control circuit of the display.

The decoders 26, 27, 28 are controlled by selector signals $A_0$, $A_1$, which are produced by the switch control circuit 50, as will be described in more detail below.

The output of amplifier 13a is also coupled to amplifier 14a, whose output is coupled through a level-shifting resistor to comprise the HUD Z signal provided to the pulse finder circuit 15. Similarly, the output of amplifier 13b is coupled to amplifier 14b, whose output is coupled through a level-shifting resistor to comprise the IOS Z signal provided to the pulse finder circuit 15.

The analog section further comprises a blanking transistor 29 coupled to the output of switch 28 to selectively couple the output to ground, thereby blanking the monitor beam intensity in response to a blanking signal "BLK."

Figure 3:
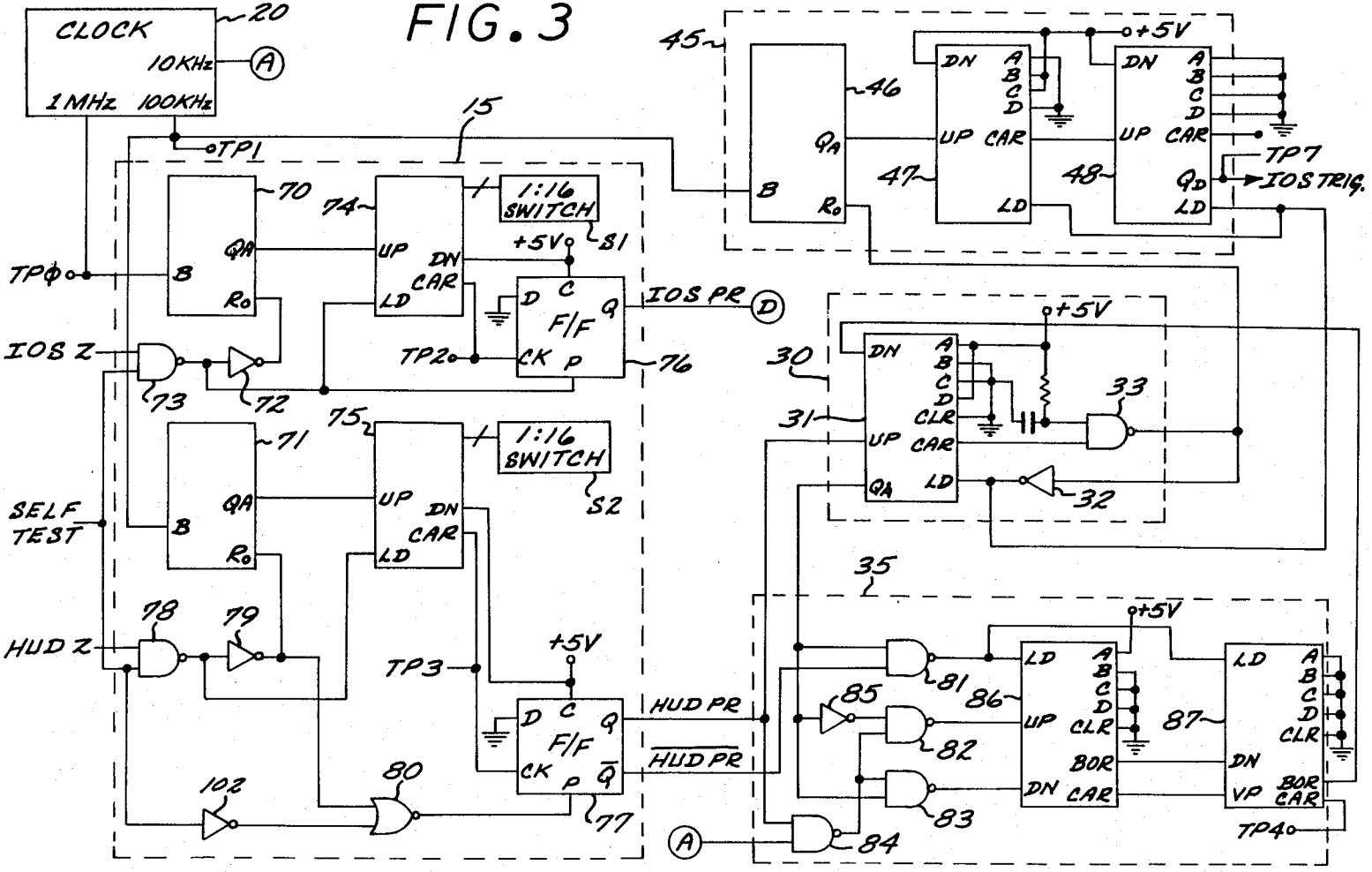

Referring now to FIG. 3, the clock circuit 20 comprises a crystal controlled oscillator and divider circuits adapted to provide stable 1 Mhz, 100 Khz and 10 Khz clock signals. The implementation of the clock circuit is conventional, and is not described in further detail.

The pulse finder circuit 15 comprises a pair of type LS290 counters, 70, 71, configured as decade counters. Counter 70 is clocked by the 1 Mhz clock signal, and a symmetrical divided-by-ten square wave is provided at the $Q_A$ output. Counter 71 is clocked by the 100 Khz clock signal, and a symmetrical divided-by-ten square wave signal is provided at its output $Q_A$.

The pulse finder circuit 15 further comprises a pair of type LS193 4-bit synchronous up/down counters 74, 75 and respective D-type LS74 flip-flops 76, 77. The counters 74, 75 and flip-flops 76, 77 are configured to provide retriggerable digital one-shot timer functions.

The HUD Z signal from circuit 10 is coupled through NAND gate 78 to the load input of counter 75, whose count-up input is coupled to the $Q_A$ output of decade counter 71. The preset value of the counter 75, and therefore the number of cycle pulses needed to trigger a "carry" signal is determined by a switchable bias circuit (indicated generally as "S2") for allowing the preset value to be selected. The carry output of the counter 75 is coupled to the clock input of flip-flop 77.

The HUD Z signal is coupled through gates 78, 79 and 80 to the preset input of the flip-flop 77, through gate 78 to the load input of counter 75, and through gates 78 and 79 to the reset terminal of counter 71. Thus, a high pulse at the HUD Z signal clears counter 71, presets counter 75 to its preset value and also presets the flip-flop 77 to the high state. Since the data input to the flip-flop 77 is grounded when the carry out signal from counter 75 clocks the flip-flop, the state of the Q output will change from high to low.

The Q and $\overline{Q}$ output of the flip-flop 77 are the "HUD PR" and "$\overline{\text{HUDPR}}$" signals. The HUD PR signal is pulsed to the high state when HUD Z pulses high, and remains in the high state until the elapsement of a predetermined delay after the HUD Z signal pulses low, determined by the position of switch S2.

Decade counter 70, up/down counter 74 and flip-flop 76 perform a similar retriggerable one-shot timer function for the IOS Z signal, with the Q output of the flip-flop 76 providing the IOS PR signal. The IOS PR signal is an envelope signal which switches to the high when the IOS Z signal pulses high and remains in the high state until the elapsement of a predetermined time delay (determined by the setting of switch S1) after the IOS Z signal remains in the low state.

The decade counter 70 for the IOS pulse finder circuit is clocked by the 1 Mhz clock signal from the clock generator 20. However, the decade counter 71 for the HUD pulse finder circuit is clocked by the 100 Khz clock signal from the clock generator 20. The IOS pulse finder circuit is more rapidly clocked than the HUD pulse finder circuit to provide additional resolution for fitting the IOS write data into the relatively short gap occurring in the HUD write cycle.

The respective waveforms for the signals HUD Z, HUD PR, IOS Z and IOS PR are illustrated in the waveform diagram of FIG. 5. As illustrated in FIG. 5, the write data for the HUD Z signal is contained in an initial relatively short data burst, followed by a short "gap" in which no write data is present, i.e., the HUD Z signal is inactive, and a second, longer data burst. The second data burst is followed by a second, relatively long gap in which no write data is present. The write cycle then commences again with a short data burst. The write cycle of the HUD Z signal is 16.67 msec, corresponding to a 60 Hz refresh rate. The HUD PR signal is a square wave "envelope" signal, representing the write data present condition for the HUD.

The IOS Z signal consists of a single data burst per cycle, which is 25 msec in length, corresponding to a 40 Hz refresh rate. The IOS PR is an envelope signal derived from the IOS Z signal.

The HUD PR signal is coupled to the pulse counter circuit 30. Circuit 30 comprises a type LS193 synchronous up/down counter 31, and the HUD PR signal is coupled to the up-count input port. The counter 31 is preset to the value 9, by the connections at terminals A, B, C, D, thereby providing a divide-by-six function, so that a carry pulse is provided at the "carry" output of the counter 31 at every sixth HUD PR pulse.

This "carry" pulse is coupled to NAND gate 33, whose outpu(t and its complement through inverter 32) is coupled to the timer circuit 45 and comprises a flag signal for resetting the timer 45. The output of NAND gate 33 resets the decode counter 46, and its complement loads the counters 47, 48. The carry output of counter 31 is illustrated in the waveform diagram of FIG. 5 as the timer 30 flag. The output of the NAND gate 33 is also coupled through inverter 32 to the load input of the counter 31.

Timer circuit 45 comprises a type LS290 counter 46, configured as a decade counter to perform a decade counting function on the 100 Khz clock signal. The timer circuit 45 further comprises synchronous up/-down type LS193 counter devices 47, 48. The symmetrical square wave output $Q_A$ of the decade counter 46 is coupled to the up-count input of counter 47. The carry output of counter 47 is coupled to the up-count input port of counter 48.

The $Q_D$ output of the counter 48 is coupled through buffering circuits (not shown) to trigger the real time clock of the IOS graphics computer. Thus, an IOS write data burst is triggered on the trailing edge of the $Q_D$ waveform (illustrated in FIG. 5).

The counters 47, 48 accept "low true" load signals. The carry pulse of the counter 31 coupled through gates 32 an 33 thus loads both counters 47, 48 with their preset values. The preset value for counter 47 is 6, and the preset value for counter 48 is zero. The least significant output bit $Q_D$ of counter 48 is set to zero by the load pulse.

With the preset values of the counters 47, 48, they operate in combination to provide a module 250 counter function when initialized by the flag signal from counter circuit 30. Thus, 25 msec after initialization, the $Q_D$ bit of counter 48 transitions from the high to low state triggering an IOS pulse. The flag signal from the carry output of counter 31 will also immediately produce a high to low transition in the state of $Q_D$, resulting in an IOS clock trigger (except on start-up, when the $Q_D$ state may start at the low state).

Thus, the timer circuit 45 provides an IOS clock trigger pulse commencing on the trailing edge of the HUD PR signal of every third short HUD PR pulse and a timed, second trigger pulse occurring 25 msec later. The timed second pulse results from the prediction that the HUD Z signal will be inactive during the time interval commencing 25 msec after the HUD PR pulse ends.

A back-up IOS trigger function is provided in the event the HUD is not functioning, i.e., if no HUD PR signals are detected, and no carry signals are produced by the counter 31. In this event, the counters 47, 48 are not initialized to their preset values, and their combination provides a module 256 counter function. This results in the provision of IOS trigger pulses every 25.6 msec, i.e., at a 39 Hz rate.

The magnitude comparator circuit 35 generates a "borrow" signal which is coupled to the "down count" input of counter 31 and ensure that the flag signal occurs on the elapsement of the short HUD PR pulse, not after the longer pulse. The magnitude comparator circuit 35 comprises NAND gates 81–84, inverter 85 and type LS193 4-bit synchronous up/down counters 86, 87. The counter 86 is clocked by the 10 Khz clock signal, either through NAND gate 82 coupled to the up-count input or through NAND gate 83 coupled to the down-count input, but only when the HUD PR signal is high.

Whether the counter 86 counts up or down depends on the state of the $Q_A$ bit from counter 31, which is applied as one input to NAND gate 83, and is inverted by inverter 85 for an input to NAND gate 82. Thus, when $Q_A$ is at the high state, counter 86 will count down, and conversely the counter 86 will count up when $Q_A$ is at the low state. This is illustrated by the waveforms shown in FIG. 5 as "CNTR 31 $Q_A$,""CNTR 86 UP," and "CNTR 86 DWN."

It is desired that the timer 30 flag signal be triggered after the short HUD PR pulse, instead of the long pulse. The counters 86 and 87 ensure that this occurs by synchronizing the high state of the least significant bit $Q_A$ of the counter 31 to the short HUD PR signal. The counters 86, 87 count up during one HUD PR pulse, and count down during the next pulse. If the counters count up during the long HUD PR signal, the number of counts will be greater than the number of down counts during the HUD PR short pulse. In this event, no borrow pulse will be generated by counter 87, whose borrow output is coupled to the down-count input of counter 31. On the other hand, if the counter 31 is synchronized on the longer HUD PR pulses, then the counters 86, 87 will count up during the short HUD PR pulse, and down during the long HUD PR pulse, so that more downcounts occur than up-counts. When counter 86 down counts past zero, the borrow pulse from counter 87 will decrement the state of counter 31. This in turn will cause the $Q_A$ output of counter 31 to change from a high state to the low state that it should be in during the long data pulse, and thus lock the counter 31 into the correct phase relative to the HUD signal.

The counters are cleared to their preset values when the $\overline{\text{HUDPR}}$ signal is high and the $Q_A$ output from counter 31 is high. The output of NAND gate 81, coupled to the load inputs of counters 86, 87, is then high. Counter 86 is preset to the value 1, and counter 87 is preset to 0. The clear signal, represented in FIG. 5 as the "CNTR 86 LOAD" signal, pulses to the low state when the $Q_A$ output of counter 31 switches to the low state.

Figure 4:
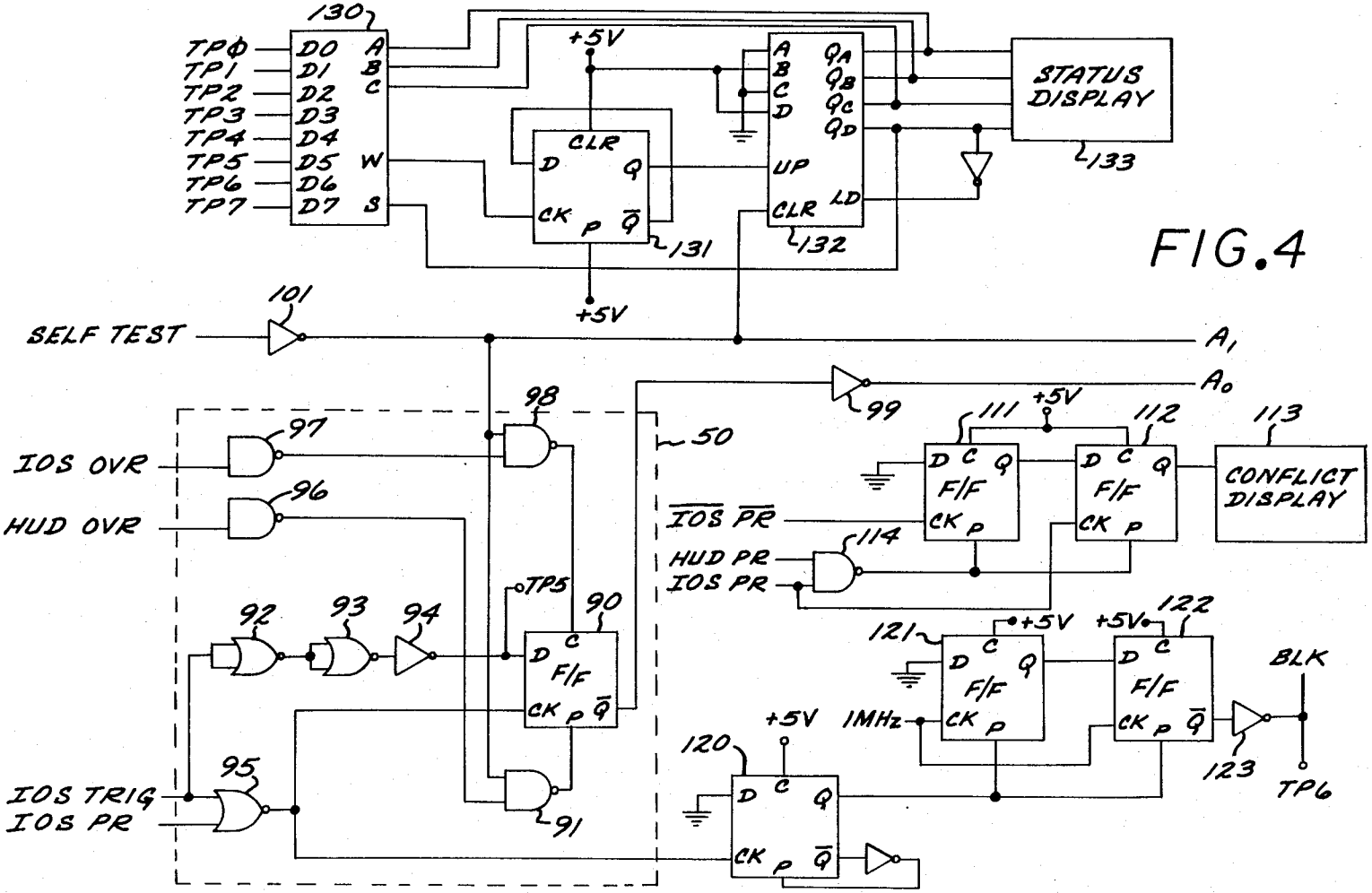

The switch control circuit 50 is illustrated in FIG. 4. This circuit is responsive to the IOS PR signal, as well as the IOS trigger signal, the override signals for the HUD and IOS ("HUD OVR" and "IOS OVR" ) and a system test signal "SELF TEST." The switch control circuit 50 functions to control the analog switches 25 so that the set of HUD image signals (X,Y,Z) are passed to the display, except during the time intervals when the IOS is writing to the display, at which time the switches 25 are commanded by the switch control circuit 50 to pass the set of IOS image signals. The override signals are provided by a system computer or by manual switches to override the normal operation of the system and display only the HUD or IOS image. Thus, activating the HUD or IOS override function will cause the signals from the selected override source to gain complete access to the display, and prevent the other source from gaining any access to the display. If both overide signals are active at the same time, the IOS override is given higher priority.

The switch control is also responsive to the SELF TEST signal to switch a set of image test signals to the display in a system self-test mode.

The switch control circuit 50 comprises a flip-flop 90, which is clocked by the output of NAND gate 95. The clear input of the flip-flop 90 is coupled to the output of NAND gate 98, controlled by the IOS OVR signal and the inverted SELF TEST signal. The preset input to the flip-flop 90 is controlled by the HUD OVR signal and the inverted SELF TEST signal, through NAND gate 91. The flip-flop 90 data input comprises the IOS trigger signal, which is inverted and delayed by the propagation delay through NOR gates 92, 93 and inverter 94. The $\overline{Q}$ output, inverted by inverter 99, provides the switch control signal $A_o$.

The IOS trigger pulse is a normally high signal which pulses low to trigger the IOS draw cycle. With the IOS PR signal low, the trigger signal pulses low to trigger the IOS draw cycle, and the NOR gate 95 output pulses high, clocking the flip-flop 90. Very quickly thereafter, in response to the IOS draw signal, the IOS PR signal goes high and the clock signal pulses low. Due to the propagation delay through the gates 92–94, the data input is still high in the leading edge of the clock, so that the switch control signal $A_o$ goes to the high state.

At the end of the IOS draw cycle, the IOS PR signal transitions from the high to the low state, causing the output of the NOR gate 95 to transition from the low to the high state, clocking the flip-flop 90 to the low state, the current inverted IOS trigger level. The switch control signal $A_o$ then switches to the low state. The NOR gate 95 output switches low when the IOS trigger signal goes low.

The waveform of the control signal $A_o$ is depicted in FIG. 5. The signal is at the high state to pass the HUD set of image signals to the display, and is at the low state to pass the IOS set of image signals.

The switch control flip-flop 90 is also responsive to HUD and IOS override signals, respectively, the HUD OVR and IOS OVR signals. These signals are coupled through NAND gates 91, 96, and 97, 98 to the preset and clear inputs of the flip-flop 90, to force the control bit $A_o$ to the respective state required to pass the overriding source signals.

The system further comprises blanking means for blanking the Z signal applied to the intensity control circuit of the display. The analog switches tend to generate noise pulses during the switching from one input signal to another, and a blanking signal BLK is generated in the transition interval to blank the beam so that the noise spikes are not displayed.

The blanking means comprises blanking transistor 29 (FIG. 2), which selectively switches the Z drive input to ground, in dependence on a blanking signal "BLK." The blanking signal "BLK" is generated by the circuit comprising flip-flops 120, 121, 122 (FIG. 4). The flip-flop 120 is clocked by the output of NOR gate 95. The $\overline{Q}$ output is coupled to the preset inputs of the flip-flops 121, 122.

The 1 Mhz clock signal from the clock generator 20 clocks both the flip-flops 121, 122. The Q output of flip-flop 121 is coupled to the data input of flip-flop 122. The blanking signal BLK is taken from the $\overline{Q}$ output of flip-flop 122 and is buffered by buffer circuits represented generally by circuit 123 to control the state of blanking transistor 29.

The function of the blanking circuit is to blank the display beam when the analog switches are switching from one input to another. With the data inputs to both flip-flops 121, 122 grounded, the output $\overline{Q}$ will be high except when preset by a pulse on the respective preset inputs. Both flip-flops 121, 122 are clocked by the high-speed 1 Mhz clock signal. With each clock pulse from the output of NOR gate 95, the $\overline{Q}$ output of flip-flop 122 pulses high for the duration of one cycle of the 1 Mhz clock signal, thus blanking the display during this interval.

The system further comprises a conflict detector for detecting write conflicts between the HUD and the IOS image sources. The detector comprises flip-flops 111, 112, NAND gate 114 and conflict display 113. The circuit is responsive to the HUD PR and IOS PR signals, and detects the condition when both signals are simultaneously high. This condition is visually indicated on the conflict display, which may comprise an LED indicator. This conflict signal may also be employed as a feedback signal to the IOS source.

The length of the HUD or IOS draw pulses may change dynamically, as the respective image content changes. Typically, a conflict will arise because the IOS write signal following the HUD PR short pulse encroaches into the long HUD PR write pulse. The conflict signal may be employed to shorten the IOS write cycle, e.g., by cancelling some low priority image information.

The conflict detector may also be used to select the appropriate time delays for the pulse finder circuits 15. The switches S1 and S2 may be set to provide the highest count value, and then adjusted progressively lower until a conflict is detected.

Another feature of the system is a self-test facility. During the self-test cycle, the clock signals at various test points TP0–TP7 in the system circuit are progressively checked, and if a failure is noted at a particular test point, the test point is indicated on the display.

The self-test circuit comprises the self-test image data generator 39 (FIG. 2), a type LS154 data selector 130, a flip-flop 131, a presettable type LS193 4-bit up-down counter 132, and alphanumeric display 133 (FIG. 4). The self-test function is initiated by a high SELF TEST signal, which enables the counter 132 and selects the first data input D0 of selector 130, coupled to test point TP0. The SELF TEST signal also overrides all other inputs to the switch control circuit 50 to cause the self-test image signals provided to the analog switches to be passed to the display.

Each time the $\overline{Q}$ output of the flip-flop 131 (clocked by the W output of data selector 130) transitions from the low to the high state, the counter 132 increments, selecting the next input (TP1) to the data selector. Only if the counter fails to increment will the display show a readable numerical designation, indicative of the current test point. A failure at a test point is indicated by a non-transitioning clock signal. Thus, the circuit provides an indication of the location of a failure in the system, simplifying its repair. The SELF TEST signal may be generated under computer or manual control, and the self-test circuit output may also be monitored by a computer.

A system has been described for superimposing two images onto a calligraphic monitor. While the disclosed embodiment is directed to an application in which the refresh rates of the two image sources are different, the invention may also be employed to superimpose images from sources having the same refresh rate. Other possible uses for this invention include applications in actual aircraft head-up displays to interface other avionics to the display without affecting normal operation and interfaces. This invention will also allow local data to be mixed with data from an uncontrollable source, such as telemetry, to enhance display of the received data.

It is understood that the above-described embodiment is merely illustrative of the possible specific embodiments of the present invention. Other arrangements may be devised by those skilled in the art without departing from the scope of the invention.

What is claimed is:

1. A system for superimposing images from two or more calligraphic image sources on a calligraphic monitor, comprising:

a calligraphic monitor comprising a cathode ray tube (CRT), respective X axis and Y axis beam deflection circuitry for respectively deflecting the CRT beam along the X and Y axes in response to analog X and Y deflection signals, and beam intensity control circuitry for controlling the intensity of the CRT beam in response to a beam intensity control signal;

a first calligraphic image source for providing a first set of periodic calligraphic image signals, comprising first analog X and Y deflection signals and a first analog beam intensity control signal, said image source having a first refresh rate of draw cycles, each draw cycle characterized by a first series of write signals, followed by a first temporal interval during which the source is not writing, in turn followed by a second series of write signals, in turn followed by a second temporal interval in which the source is not writing;

a second calligraphic image source for providing a second set of periodic calligraphic image signals comprising second analog X and Y deflection signals and a second analog beam intensity control signal, said second source controlled to provide said signals in response to a trigger signal, said second image source having a second refresh rate of draw cycles;

means for selectively coupling said first set or said second set of image signals to said calligraphic monitor in real time in dependence on a switch control signal, such that said respective first or second analog X and Y deflection signals control said X and Y beam deflection circuitry to directly deflect the CRT beam in accordance with said deflection signals, and said beam intensity control circuitry is controlled by said respective first or second analog beam intensity control signals so that the intensity of said beam is determined by said beam intensity control signal; and a calligraphic controller for controlling the operation of said second calligraphic image source, the operation of said first calligraphic image source being independent of control by said controller, comprising:

(i) means for monitoring said first set of calligraphic image signals to determine said first temporal intervals in the periodic cycle of said first set of image signals during which the first image source is not writing to the calligraphic monitor;

(ii) means for locating said second temporal interval in the cycle of said first set of image signals in dependence on the detection of said first temporal interval, said locating means comprising a timer means for providing a trigger signal a predetermined delay after detection of said first temporal location;

(iii) means responsive to said monitoring means and said locating means for generating clock trigger signals for causing said second source to generate said second set of image signals during selected ones of said first and second temporal intervals which are of duration and frequency corresponding to the cycle of the second set of calligraphic image signals; and (iv) means for generating switch control signals to couple said second set of image signals to said monitor during said selected first and second temporal intervals, and to couple said first set of image signals to said monitor when said first signal is providing image signals.

2. The system of claim 1 further comprising secondary clock means for providing secondary trigger signals to said second image source when said first image source is not operating.

3. The system of claim 1 further comprising conflict detector means for detecting conflicts between the first and second sets of image data, and providing a conflict signal indicative of the condition wherein both the first and second image sources are writing to the monitor at the same time.

4. A system for time sharing one calligraphic display monitor between a primary and a secondary calligraphic image signal source, having respective first and second refresh rates, comprising:

a calligraphic monitor comprising a cathode ray tube (CRT), respective X axis and Y axis beam deflection circuitry for respectively deflecting the CRT beam along the X and Y axes in response to analog X and Y deflection signals, and beam intensity control circuitry for controlling the intensity of the CRT beam in response to a beam intensity control signal;

a primary calligraphic image source for providing a primary set of periodic calligraphic image signals, comprising primary analog X and Y deflection signals and a primary analog beam intensity control signal, said image source having a first refresh rate of draw cycles, each draw cycle characterized by a first series of write signals, followed by a first temporal interval during which the source is not writing, in turn followed by a second series of write signals, in turn followed by a second temporal interval in which the source is not writing;

a secondary calligraphic image source for providing a secondary set of periodic calligraphic image signals, comprising secondary analog X and Y deflection signals and a secondary analog beam intensity control signal, said secondary source controlled to provide said signals in response to a trigger signal, said second image source having a second refresh rate of draw cycles;

controller means comprising means for monitoring the primary calligraphic image source signals to detect said first temporal intervals during which said primary image source is not writing to the monitor, means for locating said second temporal interval in the cycle of said first set of image signals in dependence on the detection of said first temporal location, said locating means comprising a timer means for providing a trigger signal a predetermined delay after detection of said first temporal location, and means for commanding in real time said secondary image source to write said secondary set of image signals to the display monitor during selected ones of said first and second periodic time intervals which are of frequency and duration corresponding to the cycle of the second set of calligraphic image signals, the operation of said primary image source being independent of control by said controller means.

5. A system for superimposing images from first and second image sources on a calligraphic display monitor, comprising:

a calligraphic monitor comprising a cathode ray tube (CRT), respective X axis and Y axis beam deflection circuitry for respectively deflecting the CRT beam along the X and Y axes in response to analog X and Y beam deflection control signals, and beam intensity control circuitry for controlling the intensity of the CRT beam in response to a beam intensity control signal;

a first calligraphic image signal source for providing a first set of periodic image write signals to said display monitor at a first refresh rate, said first set comprising first analog X and Y beam deflection signals and a first beam intensity control signal, said image source having a first refresh rate of draw cycles, each draw cycle characterized by a first series of write signals, followed by a first temporal interval during which the source is not writing, in turn followed by a second series of write signals, in turn followed by a second temporal interval in which the source is not writing;

a second calligraphic image signal source for providing a second set of periodic image write signals to said display monitor at a second refresh rate, said second set comprising second analog X and Y beam deflection signals and a second beam intensity control signal, said second image source adapted to provide said signals in response to a trigger signal, said second image source having a second refresh rate of draw cycles;

controller means for monitoring said first set of image write signals to locate periodic ones of said first and second temporal intervals during which said first image source is not writing to said display monitor and which are of appropriate duration and frequency to correspond to the duration and frequency of the second set of image signals, and to provide a trigger signal to said second image source to trigger and second image source to write to said display monitor in real time during said periodic time intervals, the operation of said first calligraphic image source being independent of control by said controller means, wherein said controller means comprises means for detecting the location of said first temporal intervals and a means for locating said second temporal intervals in said first set of image signals in dependence on the detection of said first temporal location, wherein said locating means comprises a timer means for providing a clock trigger signal a predetermined delay after detection of said first temporal location.

* * * * *